US006555753B2

(12) United States Patent
Rutledge et al.

(10) Patent No.: US 6,555,753 B2
(45) **Date of Patent: *Apr. 29, 2003**

(54) TUNED PATCH CABLE

(75) Inventors: Spring Rutledge, Sidney, NE (US); Jim L. Dickman, II, Sidney, NE (US); Mark W. White, Bonham, TX (US); Robert Kenny, Aurora, CO (US)

(73) Assignee: Krone, Inc., Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/055,846

(22) Filed: Jan. 23, 2002

(65) Prior Publication Data

US 2002/0062985 A1 May 30, 2002

Related U.S. Application Data

(63) Continuation of application No. 09/578,585, filed on May 25, 2000, now Pat. No. 6,365,838, and a continuation of application No. 09/578,982, filed on May 25, 2000, now Pat. No. 6,323,427, and a continuation of application No. 09/322,857, filed on May 28, 1999, now Pat. No. 6,153,826.

(60) Provisional application No. 60/137,132, filed on May 28, 1999, and provisional application No. 60/136,674, filed on May 28, 1999.

(51) Int. Cl.[7] ..... H01B 5/08

(52) U.S. Cl. ..... 174/128.1

(58) Field of Search ..... 174/113 R, 128.1, 174/128.2, 27, 110 FC, 120 R, 120 SR, 121 A

(56) References Cited

U.S. PATENT DOCUMENTS

| | | | | |
|---|---|---|---|---|
| 3,131,469 A | | 5/1964 | Glaze | |
| 4,673,775 A | | 6/1987 | Nigol | |
| 4,734,545 A | | 3/1988 | Susuki et al. | |
| 5,133,121 A | | 7/1992 | Birbeck et al. | |
| 5,493,071 A | | 2/1996 | Newmoyer | |
| 5,510,578 A | | 4/1996 | Dunlavy | |
| 5,670,748 A | | 9/1997 | Gingue et al. | |
| 5,744,757 A | | 4/1998 | Kenny et al. | |
| 5,763,823 A | * | 6/1998 | Siekierka et al. | 174/113 R |
| 5,770,820 A | | 6/1998 | Nelson et al. | |
| 5,814,768 A | | 9/1998 | Wessels et al. | |
| 6,365,838 B1 | * | 4/2002 | Rutledge et al. | 174/128.1 |

* cited by examiner

*Primary Examiner*—Chau N. Nguyen
(74) *Attorney, Agent, or Firm*—Radar, Fishman & Grauer PLLC

(57) ABSTRACT

A method of forming flexible communications wire for use in Local Area Networks is disclosed. A plurality of individual metal strands are formed into a central conductor. The central conductor is then compressed and/or heated to bond adjacent strands together and to reduce the diameter of the wire.

24 Claims, 2 Drawing Sheets

TUNED PATCH CABLE

This application is a continuation from U.S. application Ser. No. 09/578,585 entitled "TUNED PATCH CABLE" filed May 25, 2000, now U.S. Pat. No. 6,365,838 which in turn claims priority from U.S. Provisional Application Serial No. 60/137,132 entitled "TUNED PATCH CABLE" and filed on May 28, 1999; U.S. abandoned application Ser. No. 09/578,982 entitled "LOW DELAY SKEW MULTI-PAIR CABLE AND METHOD FOR MAKING THE SAME" and filed May 25, 2000, now U.S. Pat. No. 6,323,427 issued on Nov. 27, 2001 which in turn claims priority from U.S. Provisional Application Serial No. 60/136,674 entitled "LOW DELAY SKEW MULTI-PAIR CABLE AND METHOD OF MANUFACTURE" filed on May 28, 1999 abandoned, and U.S. application Ser. No. 09/322,857 entitled "OPTIMIZING LAN CABLE PERFORMANCE" and filed May 28, 1999, now U.S. Pat. No. 6,153,826 issued Nov. 28, 2000, the disclosures of which are all incorporated herein by reference.

FIELD OF THE INVENTION

The present invention relates to stranded cables, and more particularly, to stranded twisted pair patch cables for high-speed LAN applications.

BACKGROUND OF THE INVENTION

Local area networks (LAN's) now connect a vast number of personal computers, workstations, printers, and file servers in the modern office. A LAN system is typically implemented by physically connecting all of these devices with copper-conductor twisted-wire pair ("twisted-pair") LAN cables, the most common being an unshielded twisted-pair type ("UTP") LAN cable. A conventional UTP LAN cable includes four twisted pairs, i.e. 8-wires. Each of the four twisted-pairs function as a transmission line to convey a data signal through the LAN cable. Each end of the LAN cable usually terminates in a modular-type connector with pin assignments of type "RJ-45", according to the international standard IEC 603-7. Modular RJ-45 connectors may be in the form of either plugs or jacks, and a mated plug and jack is considered a connection.

In a typical installation, UTP LAN cables are routed through walls, floors, and ceilings of a building. LAN cable systems require constant care, including maintenance, upgrading and troubleshooting. In particular, LAN cables and connectors are subject to breakage or unintentional disconnection. Moreover, because offices and equipment must be moved, or because new equipment may be added to an existing LAN, the UTP cable is often manipulated and adjusted. In order to minimize disruption of a LAN system, two types of wiring are used. The first type of wiring is relatively stiff, and is installed in a substantially permanent or fixed configuration. The stiff wiring is used for horizontal connections through walls, or between floors and work areas. For the second type of wiring, a relatively short length of LAN cable, called a patch cord, is used. The patch cord includes a connector mounted on each end, and is used to interconnect between the fixed wiring of a building and the movable equipment at each end of the LAN cable system. Patch cords are typically manufactured and sold in predetermined lengths, for example two meters, with the modular RJ-45 plugs installed on either of the flexible cable.

Patch cords are an essential element of a LAN system, typically connecting moveable LAN-based equipment to a fixed module. Thus, when equipment is installed, patch cords are used to provide the final interconnection between the equipment and the rest of the LAN. To facilitate easy interconnection between the fixed wiring associated with a fixed module and the movable LAN-based equipment, the patch cord is relatively flexible. Specifically, the individual wires of a patch cord are typically formed from stranded metal conductor wires, which are more flexible than solid core wires.

Patch cords significantly impact the overall transmission quality of the LAN. Even though the cable and plugs that make up the patch cord are themselves compliant with appropriate standards, the assembled patch cord, when used as part of a user channel, may cause the user channel configuration to be out of compliance with accepted standards. Moreover, patch cords are often subject to physical abuse in user work areas as the patch cord is moved or manipulated by either the installer or the system user. As the patch cord is moved or manipulated, the strands within a wire may separate slightly, affecting the electrical properties of the wire. In particular, separation of the strands may result in greater attenuation of a data signal and impedance variations along the length of the patch cord.

To limit separation of individual strands within a wire during use, it is known to apply a tin solution to the surface of stranded copper wires to seal or bond the individual strands to adjoining strands of copper. However, tin is a poor conductor, and may adversely affect the electrical properties of the wire, and construction of tinned copper conductors requires an extra and difficult manufacturing step.

SUMMARY OF THE INVENTION

The present invention is directed to a method of forming flexible communications wire for use in Local Area Networks (LAN's). The inventive method comprises forming a metal conductor from a plurality of individual metal strands, and subjecting the metal conductor to both compression and heat to slightly adhere the strands together.

Wires formed according to the present invention are sturdier than conventional stranded conductor wires, while retaining significant flexibility. In fact, a wire formed from according to the inventive method retains more flexibility than a wire having tin bonds between individual strands. In addition, because the strands are compressed, the wire outer diameter is reduced, which also reduces attenuation effects along the length of the wire. Significantly, the compression and heating steps may be applied simultaneously, decreasing manufacturing time and complexity.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
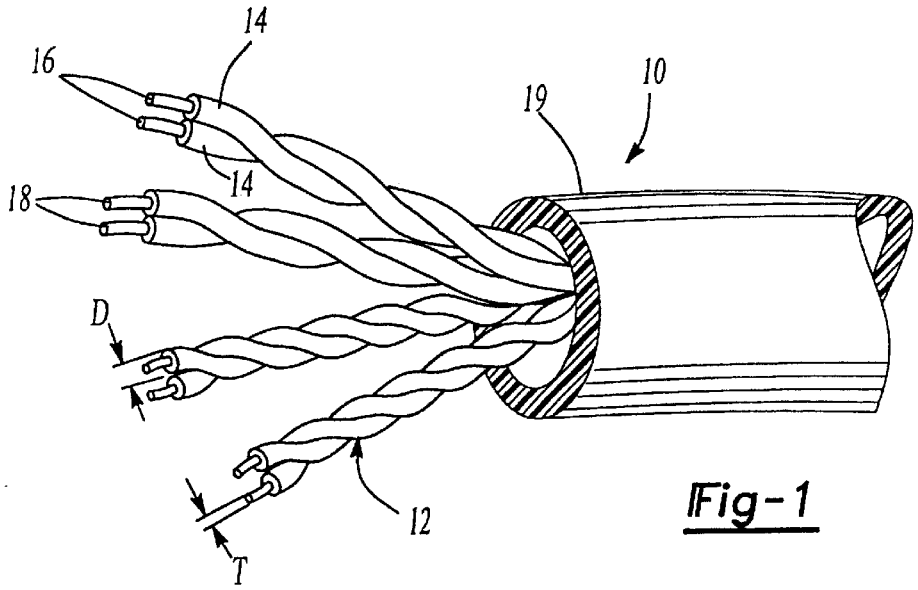
FIG. 1 is a perspective view of a UTP LAN cable.

A twisted pair LAN patch cable includes at least one pair of insulated conductors twisted about each other to form a two-conductor group. When more than one twisted pair group is bunched or cabled together, as shown in FIG. 1, it is referred to as a multi-pair cable 10. In a typical configuration, multi-pair cable 10 includes four twisted pair conductors 12. Each twisted pair 12 includes a pair of wires 14. Each wire 14 further includes a respective central conductor 16. For both economic and use-base reasons related to flexibility, the central conductor 16 typically is formed from a plurality of metal strands. A corresponding layer 18 of dielectric or insulative material also surrounds each central conductor 16. The diameter D of the central conductor 16, expressed in AWG size, is typically between about 18 to about 40 AWG, while the insulation thickness T is typically expressed in inches (or other suitable units). The insulative or dielectric material may be any commercially available dielectric material, such as polyvinyl chloride, polyethylene, polypropolylene or fluoro-copolymers (like Teflon®) and polyolefin. The insulation may be fire resistant as necessary. The twisted pairs 12 are further surrounded by a protective, but flexible cable jacket 19 with typical physical characteristics well known to those skilled in the art.

Most typically, LAN wiring consists of 4 individually twisted pairs, though the wiring may include more or less pairs as required. For example, some LAN wiring is often constructed with 9 or 25 twisted pairs. The twisted pairs may optionally be wrapped in foil shielding (not shown), but twisted pair technology is such that most often the shielding is omitted. As a result, the LAN cable is referred to as "unshielded twisted pair" wiring, or UTP.

Figure 2:
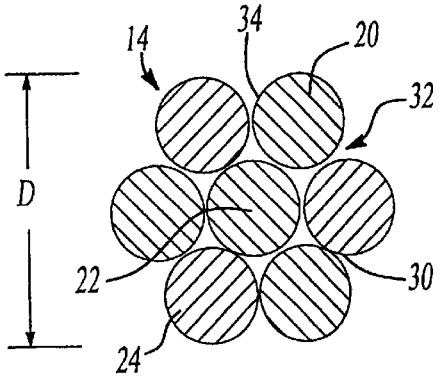
Fig-2 PRIOR ART
FIG. 2 is a cross-sectional view of a prior art standard seven-strand conductor.
Figure 4:
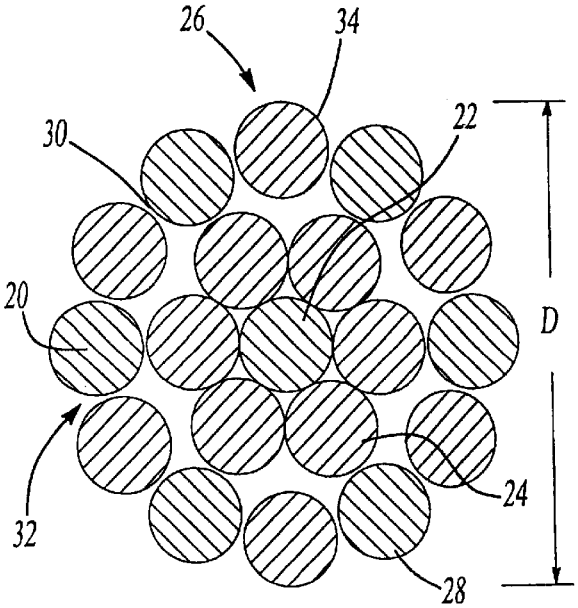
Fig-4 PRIOR ART
FIG. 4 is a cross-sectional view of a prior art standard nineteen-strand conductor.

Common prior art configurations of the stranded conductors of individual wires are shown in FIGS. 2 and 4. In FIG. 2, a stranded conductor 14 is formed from seven individual strands 20 of metal. In the most common configuration, a single strand 22 is surrounded by six strands 24, forming a symmetric cross-section. In FIG. 4, nineteen individual strands 20 are wound to form a stranded conductor 26. In the configuration shown in FIG. 4, a single strand 22 is surrounded by six strands 24, which are then surrounded by twelve strands 28. Thus, in both FIG. 2 and FIG. 4, a first layer, comprised of a single strand, is surrounded by a second layer, comprised of six individual strands. In FIG. 4, a third layer, comprised of twelve individual strands, surrounds the first two layers.

The seven- and nineteen-strand conductors represent the most efficient geometry of a stranded conductor. However, even in these configurations, formation of a wire out of multiple individual strands leaves interstitial spaces 30 between adjacent strands 20 and their defined layers as well as circumferential gaps 32 along the outer surface of the central conductor 16. Because the outer surfaces 34 of individual strands 20 interact with adjacent strands, the minimum outer diameter D is limited. Moreover, as may be appreciated, when a multiple-strand central conductor 16 is flexed or moved, the interstitial spaces 30 and circumferential gaps 32 also flex and move, and the flexing causes undesirable dynamic physical interaction between strands 20 (e.g., rubbing), thereby adversely affecting the electrical properties of the wire. As the electrical properties change within the wire, signal may be lost during transmission. Also, extensive flexing may result in permanent physical degradation to the wire and the accompanying adverse affect to its electrical properties.

Signal loss is called "attenuation", which defines the amount of signal lost as a signal travels down a wire. Attenuation is measured in decibels (dB). As stranded wire flexes, attenuation increases due to dissimilar movement of the individual strands. Additionally, "impedance" represents the best "path" for signal transmission. Impedance is affected by spacing between adjacent conductor strands. Therefore, if a cable flexes and individual conductor strands become spaced apart, impedance may increase, both in a specific location and as averaged along the length of the conductor. In particular, if a signal traversing a wire encounters a local increase in impedance, part of the signal may be reflected rather than transmitted due to an impedance mismatch. As applied to stranded central conductors, if the strands selectively separate and contact, or if the interstitial spaces and circumferential gaps selectively move and change both shape and their relative, then both local impedance and the average impedance along the entire wire are dynamically and undesirably modified.

Finally, at least along the outer circumference of central conductors 14 and 26 (FIGS. 2 and 4), a portion of the dielectric layer 18 (FIG. 1) may flow into and fill the gaps 32 when it is applied. As a result, stripping of the dielectric layer from the central conductor may be difficult.

It is known to apply a thin layer of tin to the outer circumference of each individual strand 20 so that the tin layers on adjacent stranded conductors overlap to form a tin seal between adjacent strands. In this way, lateral movement of the strands relative to each other is minimized. However, tin imparts undesirable electrical and physical characteristics to the conductor. Significantly, applying a tin layer to each stand 20 does not eliminate the interstitial spaces or circumferential gaps between individual strands, and in fact, may increase the size of each space or gap, depending upon the tin layer thickness.

Figure 3:
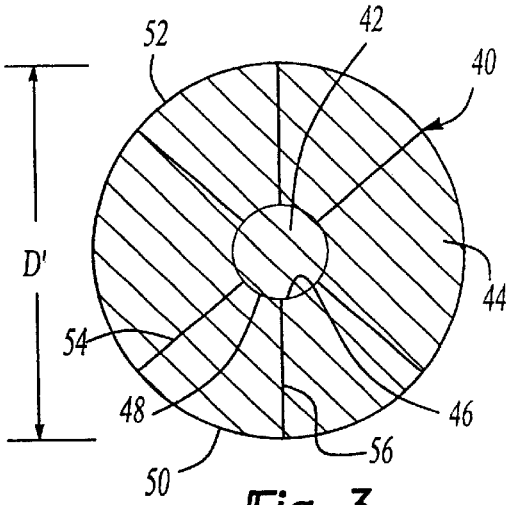
FIG. 3 is a cross-sectional view of the conductor of FIG. 2 after application of the present inventive method.

According to the present invention, rather than applying a tin layer to each strand, the central conductors are formed from multiple strands of conductive metal, and are then compressed and heated to bond the individual strands together. As seen in FIG. 3, a central conductor 40 is shown after application of the inventive method to a prior art seven-stranded central conductor (such as shown in FIG. 2). A single strand 42 forms a first layer, and six additional strands 44 form a second layer. The first layer 42 retains an essentially circular cross-sectional shape after compression, but the heating step allows the first layer to be bonded along its outer circumference 46 to the second layer.

The six wires of the second layer form an essentially symmetrical pattern around the first layer. In particular, each strand 44 is deformed under compression into a generally trapezoidal shape. A first arcuate side 48 forms a portion of the interface between the first and second layers along first layer outer circumference 46, while a second arcuate side 50 forms a portion of the outer circumferential surface 52 of the central conductor 40. Two radially extending sides 54, 56 interconnect the first arcuate side 48 and the second arcuate side 50 of adjacent strands 44. As can clearly be seen in FIG. 3, interstitial space and circumferential gaps are essentially eliminated between the strands. As a result, the outer diameter D' of central conductor 40 in FIG. 3 is less than the minimum outer diameter D of uncompressed conductor 14 of FIG. 2. Additionally, when heat is applied, a thin layer of metal on the outer circumference of each strand melts and blends with a similar layer on adjacent strands, forming bonds along the first arcuate side 48 and along the radially extending sides 54, 56. Moreover, because the circumferential gaps are eliminated, the outer surface, formed from second arcuate sides 50, is smooth, enabling a user to easily strip the insulation from the conductor.

Figure 6:
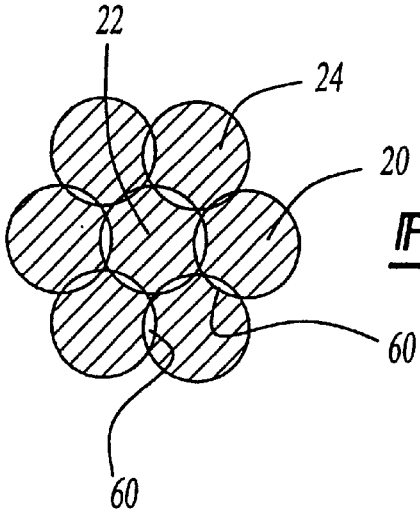
FIG. 6 is a cross-sectional view of a second embodiment of a conductor formed according to the present invention.

The compression applied to the individual strands is preferably sufficient to compress the stranded wire so that new diameter D' is between fifty and ninety percent (50–90%) of the original minimum diameter D. Compression and heat may be applied as the individual strands are brought together in a single manufacturing step, thereby reducing manufacturing time and complexity, especially over methods that first apply a tin layer to the outer surface of individual strands. It should also be noted that for those applications that do not require compression or a reduced diameter central conductor, heat alone may be applied to the strands to form a bond between adjacent strands, as shown in FIG. 6. Bonds 60 are formed between adjacent strands 20, caused by melting and blending of a small layer along the outer circumference of adjacent strands. The combination of heat and compression may therefore be varied to achieve the desired bonding between strands and a given reduced diameter D'.

Figure 5:
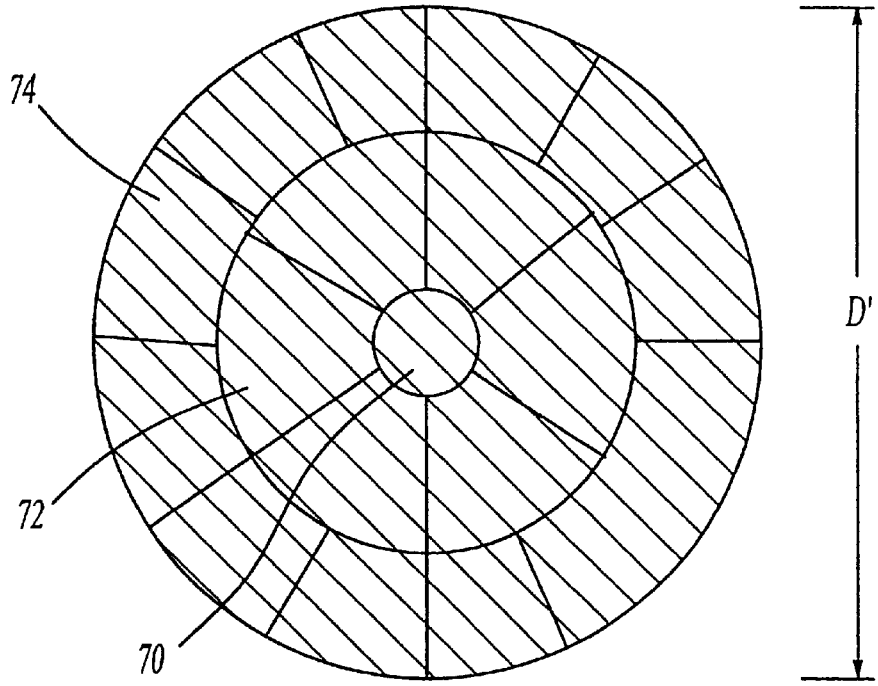
FIG. 5 is a cross sectional view of the conductor of FIG. 4 after application of the present inventive method.

For applications requiring a slightly larger central conductor, any number of additional strands 20 may be added to reach the desired diameter D'. For example, in FIG. 5, the nineteen individual strands of the prior art central conductor shown in FIG. 4 have been compressed and heated to form a three-layer central conductor. As discussed above with reference to FIG. 3, the central conductor 70 retains a generally circular cross-sectional shape, while the strands of both the first layer 72 and the second layer 74 are deformed under compression into generally symmetrical trapezoidal shapes that provide a generally smooth interface between each layer. Then, when heated, bonds are formed between adjacent surfaces as discussed above, due to melting and blending of a small layer of each strand along adjacent outer surfaces.

Preferably, the compression and heat applied to a central conductor 14 is sufficient such that when an insulated wire including central conductor 14 is bent around a four inch (4") mandrel of between two to ten times (2–10×) the insulated conductor diameter (i.e., D'+2T), the strands forming central conductor 14 remain within zero to ten percent (0–10%) of their original strand to strand orientation. In a preferred configuration, each wire is specifically designed to allow attenuation at 100 MHz of no more than 20 decibels per 100 meters with a maximum insulated conductor diameter (D'+2T) of 0.0395 inches.

To form a twisted conductor pair 12 (FIG. 1), two insulated central conductors manufactured as described above are twisted with a predetermined twist lay length. In a preferred twisted conductor pair configuration, the capacitance difference between the two insulated conductors comprising the twisted pair, measured separately, does not vary more than 0.1 pico farads (0.1 pF) per 100 meters. Moreover, the conductor to conductor outer diameter deviation should be in the range of +/−0.005 inches, and the capacitance at 1 KHz variation between insulated single conducts of a pair should not vary more than 0.1 pico farads (pF) per 100 meters. Finally, mutual capacitance at 1 KHz between twisted pair elements should vary no more than 0.5 pF per 100 meters within a multi-pair cable.

A cable 10 formed according to the present invention will then have an impedance that will not vary more than +/−2 ohms, compared to an initial reading before the test, for an average impedance that is in a range of about 1 MHz to 100 MHz, even after being flexed around a mandrel having a diameter between approximately two to ten (2–10) times the outer cable diameter. Most preferably, cable 10 may be flexed around the same mandrel repeatedly and still have an impedance variance no greater than +/−3 ohms, compared to an initial reading before the test, for the same range of average impedances. In a most preferred embodiment, cable 10 may be subjected to flexing up to twenty (20) times around the same mandrel and still maintain an impedance variance no greater than +/−3 ohms.

Figure 7:
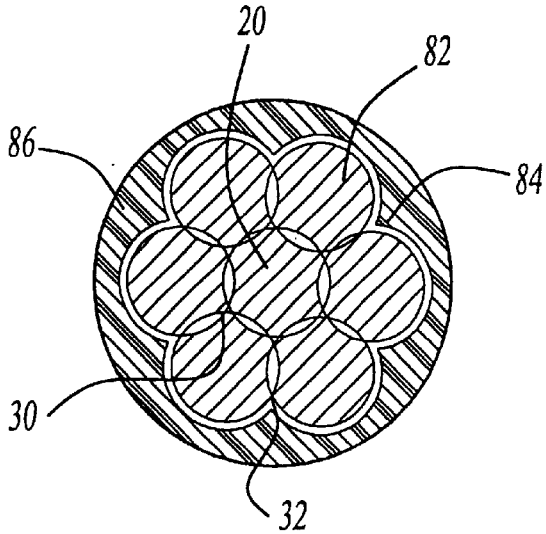
FIG. 7 is a cross-sectional view of a third embodiment of a conductor formed according to the present invention.

A final embodiment of the present invention is shown in FIG. 7 that avoids the use of tin to hold individual strands in place. Instead, at least one layer of flexible dielectric coating 80 is bonded to the strands to tightly hold each strand in place. In a preferred embodiment, shown in FIG. 7, a bare copper or coated copper conductor 82 includes seven individual strands 20. Though the conductor is shown in FIG. 7 without the individual strands 20 bonded and compressed together, it should be understood that the following description is applicable to a compressed and bonded conductor such as that shown in FIG. 3. The conductor 82, made of seven strands 20, is first coated with an inner layer 84 and an outer layer 86 of insulating dielectric material. Inner coating 84 is preferably a material that, when in a molten form during extrusion, exhibits a relatively low viscosity to flow more readily and fill the interstitial spaces 30 and gaps 32 of the bonded strands to form a tight, high-strength bond to the strands 20 and about the conductor 82. As a result, removal of inner layer 84 requires a relatively high strip force. After application, inner layer 84 acts to hold the strands 20 tightly together to prevent separation of the strands due to flexing of the wire during normal usage of the finished cable. Most preferably, inner dielectric layer 84 is extruded to an approximate thickness of 0.003" maximum wall thickness, which is thick enough to bond the strands together while allowing sufficient flexibility of the wire during use.

After application of inner layer 84, the second, outer layer 86 is then applied in such a way that forms a physical bond to inner layer 84 after extrusion. Outer layer 86 is applied to a predetermined thickness so that the wire when paired, jacketed and optionally shielded exhibits a desired average impedance, typically 100 Ohms. Additionally, outer layer 86 is formed from a material of a desired hardness that prevent deformation during twinning with a wire of like make when up to 1500 grams of tension is applied to each wire (such as when forming twisted pairs). In particular, the two layers 84, 86 are chosen to exhibit an effective dielectric constant about the conductor of 2.6 or less.

Preferably, the inner layer is formed from a linear low density polyolefin material or a medium density polyolefin material. The outer layer may be formed of a high density polyolefin, including Fluorinated Ethylenepropylene (FEP), Ethylene Chlorotrifluoroethylene (ECTFE) or tetrafluoroethylene (TFE)/perfluoromethylvinylether (MFA). Additionally, either or both of the first and second layers may be mixed with a flame retardant package such that the dual insulated layer exhibits a limited oxygen index (LOI) of 28% or greater.

Though the wires formed using the present invention use multiple individual strands to form the central conductor, the strands are bonded together sufficiently to prevent separation or gaps between individual strands. As a result, the electrical properties of the stranded conductors are stabilized to mimic those of a rigid conductor while still permitting the necessary ability for the wire to flex or move to provide interconnection between the fixed module and the LAN-based component. Yet, because no tin is used to bond the strands together, the wire formed according to the present invention is actually more flexible than a tinned conductor, and the bonds between strands are less likely to break despite significant wire manipulation, as the wire is used. Moreover, the minimum outer diameter of the wire formed according to the inventive method is also reduced. Despite the smaller diameter, however, each wire suffers less attenuation of a data signal transmitted thereby when compared to the prior art. Moreover, if desired, more strands of a wire may be used within a defined space to further improve wire performance over pre-existing wires. Alternatively, more wires may be fit within a pre-existing sized jacket. In the case of special environmental conditions (e.g., fireproof layers), the insulation layer may be increased without increasing jacket size.

Preferred embodiments of the present invention have been disclosed. A person of ordinary skill in the art will realize, however, that certain modifications and alternative forms will come within the teachings of this invention. For example, diameters of individual conductors and their insulation layer may be adjusted as necessary. Therefore, the following claims should be studied to determine the true scope and content of the invention.

What is claimed is:

1. A cable comprising:

a plurality of insulated stranded conductors formed into twisted pairs and embodied into an overall casing, each of said plurality of insulated stranded conductors comprised of a plurality of conductor strands constituting a single conductive material assembled into a singular unit having an original diameter and compressed to at least 50 percent of said original diameter; wherein said conductor strands are heated after being compressed to create a bond between adjacent strands by blending a surface portion of said single conductive material and then coated with insulation to form each insulated stranded conductor such that when bent around a 4 inch mandrel of between 2 to 10 times the outer dimensions of each insulated stranded conductor, each strand of each insulated stranded conductor remains within 0–10% of its original strand to strand orientation.

2. A cable as recited in claim 1, where after each stranded conductor is flexed around the outer dimensions of said insulated conductor, averaged impedance of said conductor from a range of about 1 MHz to 100 MHz will not vary more than +/−2 ohms.

3. A cable of claim 2, where each stranded conductor is flexed around the mandrel repeatedly, no more than 20 times, the impedance of said conductor varies no more than +/−3 ohms.

4. A cable of claim 1, wherein said insulation comprises a dielectric coating for holding said conductor strands in place.

5. A cable of claim 4, wherein the coating is between 0.001" to 0.003" in thickness.

6. A cable of claim 1, wherein one of said plurality of conductor strands vary in diameter with respect to a different one of said plurality of conductor strands.

7. A cable of claim 1, wherein a thickness of said insulation is different between at least two of said insulated stranded conductors.

8. A cable of claim 1, that has a maximum conductor to conductor outer diameter deviation of +/−0.005".

9. A cable of claim 1, that has no more than +/−4 ohms difference in average impedance variation between intertwined pairs of said conductors.

10. A cable of claim 1 with each of said conductors having a maximum diameter of 0.0395 inches and allowing attenuation at 100 MHz of no more than 20 dB per 100 meters.

11. A cable of claim 1, where the capacitance at 1 KHz variation between an intertwining pair of said conductor vary no more than 0.1 pF per 100 meters.

12. A cable of claim 1, with an intertwined pair of said conductors forming a twisted pair element, the mutual capacitance at 1 KHz of each twisted pair element within said cable varying no more than 0.5 pF per 100 meters.

13. A wire as recited in claim 1, wherein said insulation comprises a first dielectric coating applied to said stranded conductor to hold said conductor strands in place relative to each other and to prevent separation of said conductor strands during flexing of the wire; and a second dielectric coating applied to and bonded to said first coating.

14. A cable of claim 1, wherein each stranded conductor is flexed around a mandrel repeatedly, no more than 20 times, an impedance of said conductor varies no more than +/−3 ohms.

15. A wire for use in a high speed LAN cable, comprising:

a central conductor including a plurality of individual strands, each of said plurality of insulated stranded conductors comprised of a plurality of conductor strands constituting a single conductive material assembled into a singular unit, wherein said strands are compressed and heated after being compressed to create a bond between adjacent strands by blending a surface portion of said single conductive material, said strands combined to form a predetermined number of layers;

a first dielectric coating applied to said central conductor to hold said strands in place relative to each other and to prevent separation of said strands during flexing of the wire; and a second dielectric coating applied to and bonded to said first coating.

16. The wire of claim 15, wherein said central conductor includes 7 strands.

17. The wire of claim 15, wherein said first coating is less than or equal to 0.003 inches thick.

18. The wire of claim 17, wherein said second coating is applied to a predetermined thickness such that the wire when paired, jacketed and optionally shielded exhibits an average impedance of about 100 Ohms per 100 meters.

19. The wire of claim 15, wherein said first coating comprises a material having a sufficiently low viscosity during application in a molten form to fill any interstitial spaces and gaps between adjacent strands.

20. The wire of claim 15, wherein said first coating is selected from the group consisting of a linear low density material and a linear medium density polyolefin material.

21. The wire of claim 20, wherein said second coating is a high density polyolefin.

22. The wire of claim 20, wherein said second coating is selected from the group consisting of Fluorinated Ethylenepropylene (FEP); Ethylene chlorotrifluoroethylene (ECTFE); and tetrafluoroethylene (TFE)/perfluoromethylvinylether (MFA).

23. The wire of claim 15, wherein a flame retardant additive package is mixed with said first or second coating such that the dual insulated layer exhibits a limited oxygen index of 28% or greater.

24. A cable comprising:

a plurality of insulated stranded conductors formed into twisted pairs and embodied into an overall casing, each of said plurality of insulated stranded conductors comprised of a plurality of conductor strands constituting a single conductive material assembled into a singular unit having an original diameter and compressed to at least 50 percent of said original diameter; wherein said plurality of conductor strands are heated after being compressed to create a bond between adjacent strands by blending a surface portion of said single conductive material.

* * * * *